US009064474B2

(12) United States Patent
Chou et al.

(10) Patent No.: US 9,064,474 B2
(45) Date of Patent: Jun. 23, 2015

(54) N-TH STAGE DRIVING MODULE WITH COMMON CONTROL NODE

(71) Applicant: Giantplus Technology Co., Ltd., Miao-Li County (TW)

(72) Inventors: Kai-Ju Chou, Miao-Li County (TW); Che-Yao Wu, Miao-Li County (TW); Ku-Huang Lai, Miao-Li County (TW); Po-Chun Huang, Miao-Li County (TW)

(73) Assignee: Giantplus Technology Co., Ltd., Miao-Li County (TW)

( * ) Notice: Subject to any disclaimer, the term of this patent is extended or adjusted under 35 U.S.C. 154(b) by 161 days.

(21) Appl. No.: 13/870,187

(22) Filed: Apr. 25, 2013

(65) Prior Publication Data

US 2014/0198022 A1 Jul. 17, 2014

(30) Foreign Application Priority Data

Jan. 15, 2013 (TW) ..... 102101424 A

(51) Int. Cl.
*G09G 3/36* (2006.01)

(52) U.S. Cl.
CPC ..... *G09G 3/3677* (2013.01); *G09G 2310/0283* (2013.01); *G09G 2310/0286* (2013.01)

(58) Field of Classification Search
USPC ..... 345/92, 204, 212
See application file for complete search history.

(56) References Cited

U.S. PATENT DOCUMENTS

| | | | | |
|---|---|---|---|---|
| 8,031,154 | B2 * | 10/2011 | Mamba et al. | 345/96 |
| 8,406,372 | B2 * | 3/2013 | Hsu et al. | 377/64 |
| 8,724,406 | B2 * | 5/2014 | Tseng et al. | 365/189.12 |
| 2007/0297559 | A1 * | 12/2007 | Cho et al. | 377/64 |
| 2011/0273417 | A1 | 11/2011 | Shin et al. | |

FOREIGN PATENT DOCUMENTS

TW 201141064 A 11/2011

* cited by examiner

*Primary Examiner* — Kwang-Su Yang
(74) *Attorney, Agent, or Firm* — Rosenberg, Klein & Lee

(57) ABSTRACT

An n-stage driving module with a common control node according to the present invention is revealed. The n-stage driving module comprises a plurality of output units, a forward input unit and a reverse input unit. The output units are all coupled to a control node to share the control node. The output units output forward scanning signals sequentially according to the charge of the control node when the control node is charged by the forward input unit. The output units output reverse scanning signals sequentially according to the charge of the control node when the control node is charged by the reverse input unit. Thus, the present invention is provided to output forward or reverse scanning signals from the output units by sharing the control node so as to decrease the circuit area in the n-stage driving module.

6 Claims, 5 Drawing Sheets

N-TH STAGE DRIVING MODULE WITH COMMON CONTROL NODE

FIELD OF THE INVENTION

The present invention relates generally to a driving circuit, and particularly to an n-th stage driving module with a common control node.

BACKGROUND OF THE INVENTION

With the prosperous development of modern technologies, novel information products are introduced for satisfying people's various needs. Compared with conventional displays, liquid crystal displays (LCDs) have the advantages of light and compact size, low radiation, and low power consumption. Thereby, current conventional displays in the market have being replaced by LCDs gradually, making LCDs the mainstream in the display market. No matter which type of LCDs, a driving circuit is required for driving the LCD panel. On a thin-film transistor (TFT) panel, a bidirectional scanning driving circuit is used for controlling if the TFT of the pixel structure receives the data signal provided by the data driving circuit. Thereby, the pixel electrode of the pixel can have the voltage corresponding to the data signal, and thus forming the electric field between the common electrode and the pixel electrode for driving the liquid crystals therebetween to rotate. In addition, the rotating angle of the liquid crystals can be adjusted by varying the intensity of the electric field. Because the bidirectional scanning driving circuit outputs scanning signals to the gates of the TFTs for driving, the bidirectional scanning driving circuit can also be named a gate driving circuit.

A conventional TFT-LCD panel is formed by attaching a TFT panel glass to a color filter glass and filling the gap therebetween with liquid crystal molecules. In order to reduce the number of devices as well as lowering the manufacturing cost, the trend is to fabricate the driving circuit structure on the display panel directly in recent years. For example, the gate on array (GOA) technology is to integrate the gate driving circuit on the liquid crystal panel. This novel mass-production technology performs the color-filter process after completing the TFT array on the TFT panel glass. This technology can improve the aperture ratio of pixels and thus enhancing the brightness of the panel.

The bidirectional scanning driving circuit is required to respond rapidly and have light and compact designs for LCD panels. In addition, for supporting bidirectional scanning, the influence among devices in the circuit should be reduced and the interference among signals should be minimized as well. Thereby, the layout of the control circuit for bidirectional scanning in the scanning driving circuit needs to be simplified. Moreover, as the size of LCD devices increases according to the requirements of the market, the area of the driving circuit disposed in the LCD devices increases correspondingly. Thereby, the electrical properties, and hence the frame size, of the LCD device are influenced by the driving circuit.

Accordingly, the present invention provides an n-th stage driving module with a common control node, in which the control node is shared and thus combining the output units for reducing the area of the driving circuit. Besides, the present invention can also be applied to the GOA technology for disposing the driving circuit on a thin panel and can support the bidirectional scanning.

SUMMARY

An objective of the present invention is to provide an n-th stage driving module with a common control node, which reduces the area of the driving circuit.

Another objective of the present invention is to provide an n-th stage driving module with a common control node, which provides the scanning signal for bidirectional scanning.

Still another objective of the present invention is to provide an n-th stage driving module with a common control node, which provides a plurality of clock signals to the driving circuit for reducing the operating time of transistors and thus reducing the power consumption.

The present invention provides an n-th stage driving module with a common control node, which receives a plurality of clock signals, a first input voltage, and a second input voltage, and produces and outputs a plurality of scanning signals to a display panel sequentially. The n-th stage driving module comprises a plurality of output units, a forward input unit, and a reverse input unit; the plurality of output units are all coupled to a control node. The forward and reverse input units are coupled to the plurality of output units via the control node. For the n-th stage driving module, the forward input unit receives the first input voltage and a front forward scanning signal of the output unit of any of the plurality of driving modules lower than or equal to the (n−1)th stage. The forward input unit charges or discharges the control node according to the first input voltage and the front forward scanning signal. The reverse input unit receives the second input voltage and a back reverse scanning signal of the output unit of any of the plurality of driving modules higher than or equal to the (n+1) th stage. The reverse input unit charges or discharges the control node according to the second input voltage and the back reverse scanning signal. The plurality of output units receive the plurality of clock signals. Thereby, when the forward input unit is charging the output unit, a plurality of forward scanning signals are produced and output sequentially; when the reverse input unit is charging the control node, a plurality of reverse scanning signals are produced and output sequentially.

DETAILED DESCRIPTION

In order to make the structure and characteristics as well as the effectiveness of the present invention to be further understood and recognized, the detailed description of the present invention is provided as follows along with embodiments and accompanying figures.

Figure 1A:
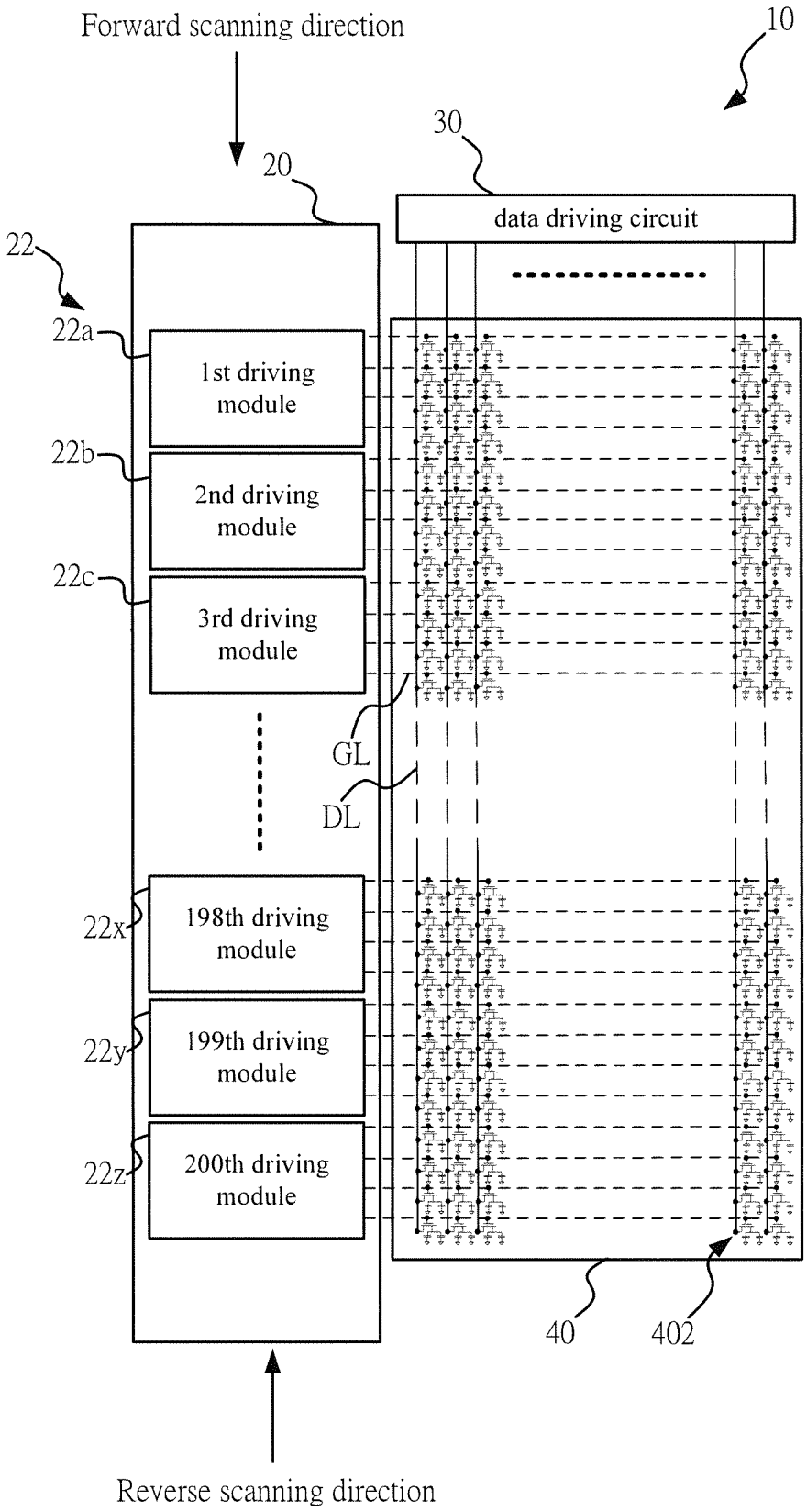
FIG. 1A shows a block diagram of the display device according to an embodiment of the present invention.

FIG. 1A shows a block diagram of the display device according to an embodiment of the present invention. As shown in the figure, the display device 10 comprises a bidirectional scanning driving circuit 20, a data driving circuit 30, and a display panel 40. The bidirectional scanning driving circuit 20 includes a plurality of driving modules 22. The driving modules 22 according to the present embodiment include a first driving module 22*a*, a second driving module 22*b*, a third driving module 22*c*, and so on to a 198th driving module 22*x*, a 199th driving module 22*y*, and a 200th driving module 22*z*. According to the present embodiment, the display device 10 has 800 scanning lines; each driving module 22 outputs 4 scanning signals. Thereby, the number of the driving modules 22 is 200. Besides, the display panel 40 includes a plurality of pixels 402.

The display panel 40 has a plurality of scanning lines GL and a plurality of data lines DL. The plurality of driving modules 22 of the bidirectional driving circuit 20 are coupled to a portion of the plurality of pixels 402 via four scanning lines GL, respectively. Nonetheless, the present invention is not limited to this; the driving modules 22 can have more number of connections of the scanning lines GL according to application. In addition, each of the driving modules 22 according to the present invention can be coupled to at least three scanning lines GL. The data driving circuit 30 is coupled to the plurality of pixels 402 via the plurality of data lines DL. The display device 10 outputs a plurality of scanning signals to the plurality of connected pixels 402 sequentially by means of the plurality of driving modules 22 for driving the plurality of pixels 402 to receive the data signals outputted by the data driving circuit 30. The display device 10 according to the present invention supports bidirectional scanning, which means that the order the bidirectional scanning driving circuit 20 outputs the scanning signals can be the forward scanning direction, in which the plurality of driving modules 22 output the scanning signals top-down and sequentially, for example, in the order of the first driving module 22*a* producing the scanning signal first to the 200th driving module 22*z* producing the scanning signal last sequentially. Alternatively, the plurality of driving modules 22 output the scanning signals bottom-up and sequentially, for example, in the order of the 200th driving module 22*z* producing the scanning signal first to the first driving module 22*a* producing the scanning signal last.

Figure 1B:
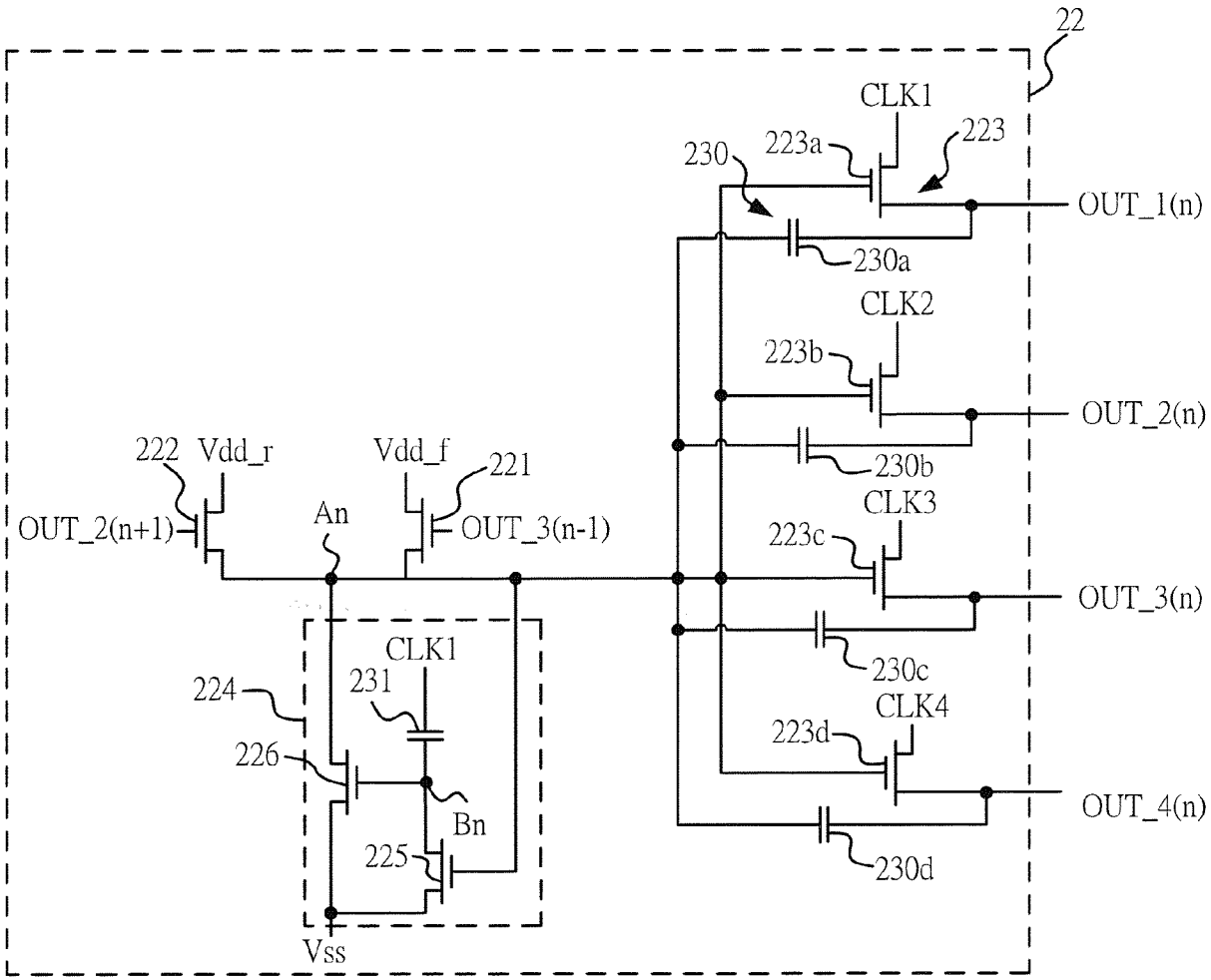
FIG. 1B shows a block diagram of the n-th stage driving module according to an embodiment of the present invention.

FIG. 1B shows a block diagram of the driving module according to an embodiment of the present invention. As shown in the figure, the driving module 22 according to the present invention is applied to a driving circuit such as a bidirectional scanning driving circuit. The driving module 22 comprises a forward input unit 221, a reverse input unit 222, and a plurality of output units 223. According to the present embodiment, four output units 223, namely, a first output unit 223*a*, a second output unit 223*b*, a third output unit 223*c*, and a fourth output unit 223*d*, are used as an example. In addition, the driving module 22 further comprises a noise free unit 224 and a plurality of output capacitors 230. According to the present embodiment, four output capacitors 230, namely, a first output capacitor 230*a*, a second output capacitor 230*b*, a third output capacitor 230*c*, and a fourth output capacitor 230*d*, are used as an example. Besides, the noise free unit 224 includes a first transistor 225, a second transistor 226, and a control capacitor 231.

The control node An is coupled to a first terminal of the first output unit 223*a*, a first terminal of the second output unit 223*b*, a first terminal of the third output unit 223*c*, and a first terminal of the fourth output unit 223*d*. A first terminal of the forward input unit 221 is coupled to a front output OUT_3(n−1) of any driving module lower than or equal to (n−1)th stage. For example, as shown in FIG. 1A, the forward input unit of the 200th driving module 22*z* is coupled to the third output of the 199th driving module 22*y*. A second terminal of the forward input unit 221 receives the first input voltage Vddf. A first terminal of the reverse input unit 222 is coupled to a back output OUT_2(n+1) of any driving module higher than or equal to (n+1)th stage. For example, as shown in FIG. 1A, the reverse input unit of the first driving module 22*a* is coupled to the second output of the second driving module 22*b*.

A second terminal of the reverse input unit 222 receives the second input voltage Vdd_r; the third terminal of the forward input unit 221 and the third terminal of the reverse input unit 222 are coupled to the control node An, respectively. A second terminal of the first output unit 223*a* receives a first clock signal CLK1; a third terminal of the first output unit 223*a* is coupled to a first output OUT_1(n). A second terminal of the second output unit 223*b* receives a second clock signal CLK2; a third terminal of the second output unit 223*b* is coupled to a second output OUT_2(n). A second terminal of the third output unit 223*c* receives a third clock signal CLK3; a third terminal of the third output unit 223*c* is coupled to a third output OUT_3(n). A second terminal of the fourth output unit 223*d* receives a fourth clock signal CLK4; a third terminal of the fourth output unit 223*d* is coupled to a fourth output OUT_4(n).

The first output capacitor 230*a* is coupled between the control node An and the first output OUT_1(n). In other words, a first terminal of the first output capacitor 230*a* is coupled to the control node An, and a second terminal of the first output capacitor 230*a* is coupled to the first output OUT_1(n). The second output capacitor 230*b* is coupled between the control node An and the second output OUT_2(n). In other words, a first terminal of the second output capacitor 230*b* is coupled to the control node An, and a second terminal of the second output capacitor 230*b* is coupled to the second output OUT_2(n). The third output capacitor 230*c* is coupled between the control node An and the third output OUT_3(n). In other words, a first terminal of the third output capacitor 230*c* is coupled to the control node An, and a second terminal of the third output capacitor 230*c* is coupled to the third output OUT_3(n). The fourth output capacitor 230*d* is coupled between the control node An and the fourth output OUT_4(n). In other words, a first terminal of the fourth output capacitor 230*d* is coupled to the control node An, and a second terminal of the fourth output capacitor 230*d* is coupled to the fourth output OUT_4(n).

The noise free unit 224 is coupled to the control node An. Thereby, the noise free unit 224 is coupled to the forward input unit 221, the reverse input unit 222, and the output unit 223. In addition, the noise free unit 224 also receives the first clock signal CLK1. The control capacitor 231 receives the first clock signal CLK1 and is coupled to the first and second transistors 225, 226. The first and second transistors 225, 266 are coupled to the control node An and the reference voltage Vss, respectively. A first terminal of the first transistor 225 is coupled to the control node An; a second terminal of the first transistor 225 is coupled to the control capacitor 231; and a third terminal of the first transistor 225 is coupled to the reference voltage Vss. A first terminal of the second transistor 226 is coupled between the control capacitor 231 and the second terminal of the first transistor 225; a second terminal of the second transistor 226 is coupled to the control node An; and a third terminal of the second transistor 226 is coupled to the reference voltage Vss.

Figure 2A:
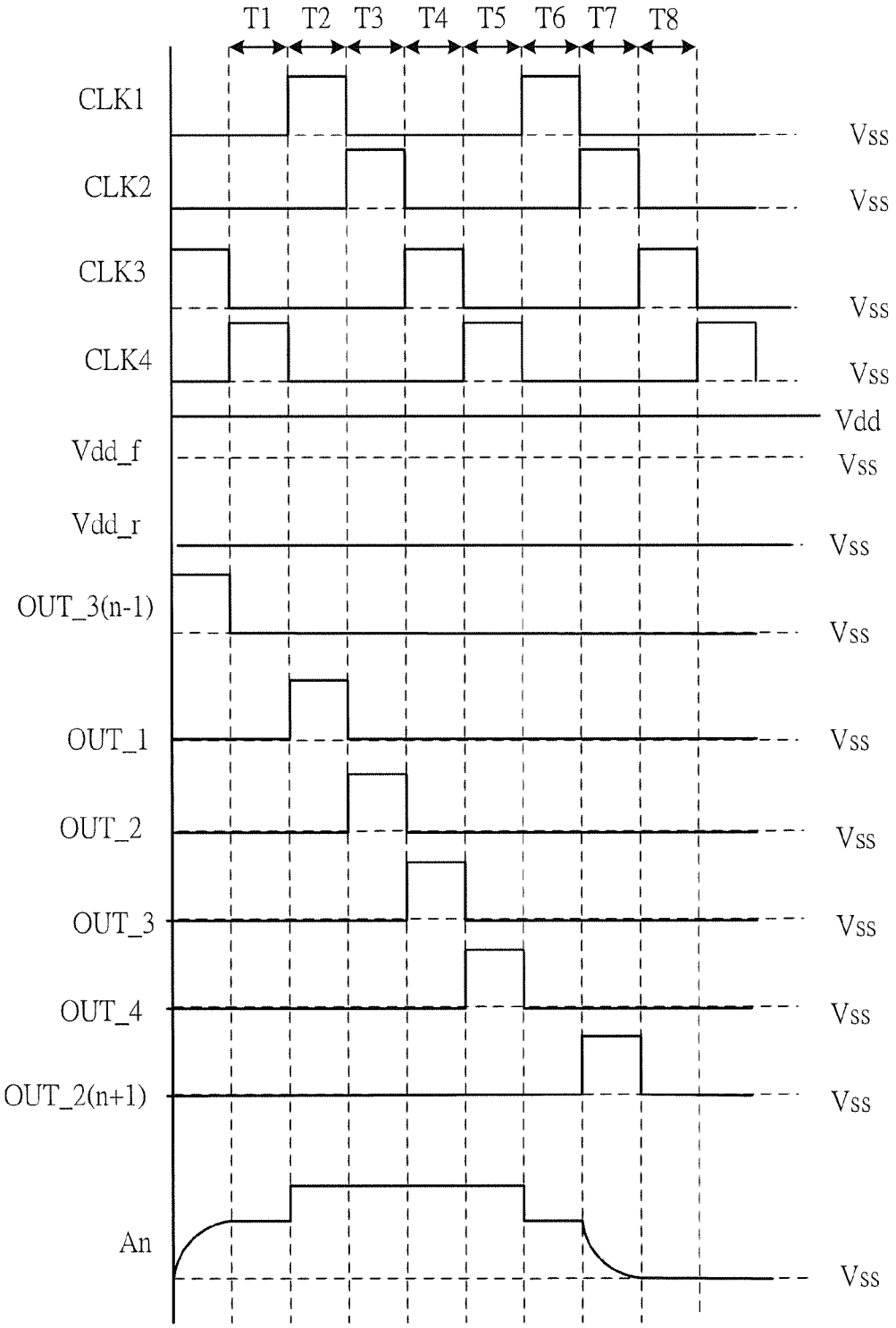
FIG. 2A shows waveforms of the driving signals during forward scanning according to an embodiment of the present invention.

The forward input unit 221 receives a front forward scanning signal via the front output OUT_3(n−1) for charging the control node An according to the first input voltage Vdd_f and the front forward scanning signal. When the forward input unit 221 charges the control node An according to the first input voltage Vdd_f and the front forward scanning signal, the plurality of output units 223*a*, 223*b*, 223*c*, 223*d* produce a plurality of forward scanning signals and transmit them to the plurality of outputs OUT_1(n), OUT_2(n), OUT_3(n), and OUT_4(n) sequentially according to the received first clock signal CLK1, second clock signal CLK2, third clock signal CLK3, and fourth clock signal CLK4, respectively. As the forward input unit 221 charges the control node An to make the plurality of output units 223 output the plurality of forward scanning signals, the reverse input unit 222 will discharge the control node An when the plurality of output units 223a, 223b, 223c, 223d produce the plurality of forward scanning signals after a period of time, particularly, a clock cycle time. Consequently, the voltage of the control node An will be pulled down. For example, as shown in FIG. 2A, the plurality of output units 223a, 223b, 223c, 223d produce a plurality of forward scanning signals sequentially in the clock cycle times between T2 and T5, and discharging occurs at the clock cycle time T7. This is the forward scanning mode of the driving circuit. For example, as shown in FIG. 1A, in the order from the first driving module 22a to the 200th driving module 22z, a plurality of scanning signals are produced and transmitted sequentially to the scanning lines GL for forward scanning the plurality of pixels 402.

The reverse input unit 222 charges the control node An according to the second input voltage Vdd_r and the back reverse scanning signal. When the reverse input unit 222 charges the control node An according to the second input voltage Vdd_r and the back reverse scanning signal, the plurality of output units 223a, 223b, 223c, 223d produce a plurality of reverse scanning signals and transmit them to the plurality of outputs OUT_1(n), OUT_2(n), OUT_3(n), and OUT_4(n). As the reverse input unit 222 charges the control node An to make the plurality of output units 223a, 223b, 223c, 223d output the plurality of reverse scanning signals, the forward input unit 221 will discharge the control node An after a period of time, particularly, a clock cycle time, when the plurality of output units 223a, 223b, 223c, 223d produce the plurality of reverse scanning signals. For example, as shown in FIG. 2A, the plurality of output units 223a, 223b, 223c, 223d produce a plurality of reverse scanning signals sequentially in the clock cycle times between T2 and T5, and discharging is occurred at the clock cycle time T7. This is the reverse scanning mode of the driving circuit. For example, as shown in FIG. 1A, in the order from the 200th driving module 22z to the first driving module 22a, a plurality of scanning signals are produced and transmitted sequentially to the scanning lines GL for reversely scanning the plurality of pixels 402.

Furthermore, please refer again to FIG. 1B. The noise free unit 224 filters out the noises at the control node An. The control capacitor 231 produces a control level Bn according to the first clock signal CLK1. The first transistor 225 judges if the control level Bn is to be pulled down to the reference voltage Vss according to the voltage of the control node An and hence controlling the second transistor 226 to filter out the noises at the control node An.

Figure 2B:
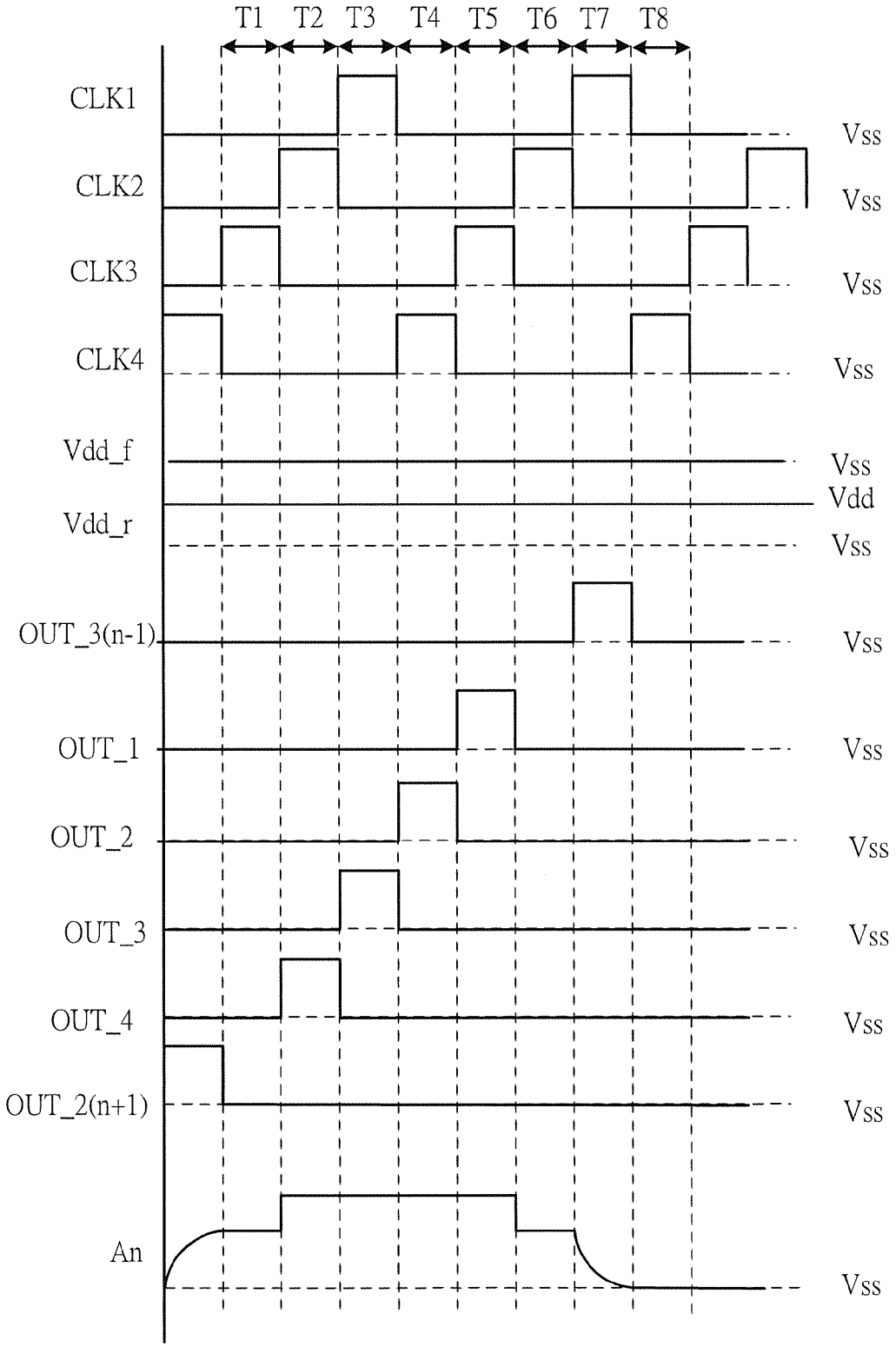
FIG. 2B shows waveforms of the driving signals during reverse scanning according to an embodiment of the present invention.

Please refer to FIGS. 1B, 2A, and 2B. FIG. 2A and FIG. 2B show waveforms of the driving signals during forward and reverse scanning according to an embodiment of the present invention, respectively. As shown in FIG. 2A, it shows waveforms of a driving circuit in the forward scanning mode. When the driving module 22 is in the forward scanning mode, the forward input unit 221 is used for charging the control node An. On the other hand, in the forward scanning mode, the reverse input unit 222 discharges the control node An after a clock cycle time when the plurality of output units 223a, 223b, 223c, 223d produce the forward scanning signals. Thereby, the first input voltage Vdd_f is high leveled (Vdd) while the second input voltage Vdd_r is low leveled. According to the present embodiment, the second input voltage Vdd_r is pulled down to the reference voltage Vss.

Refer again to FIGS. 1B and 2A. At the clock cycle time T1, the forward input unit 221 is turned on according to the fourth scanning signal of the forward output OUT_3(n−1) for charging the control node An. Meanwhile, the plurality of outputs OUT_1(n), OUT_2(n), OUT_3(n), and OUT_4(n) are low leveled. At the clock cycle time T2, the control node An is a floating point. Thereby, the control node An is no more charged by the forward input unit 221. At the same time, because the control node An is high leveled, the first output unit 223a receives the first clock signal CLK1 and transmits the voltage of the first clock signal CLK1 to the first output OUT_1(n). By raising the voltage level of the control node An via the first output capacitor 230a, the first output unit 223a charges the first output OUT_1(n) rapidly. At the clock cycle time T3, the control node An is a floating point. Because the control node An is high leveled, the second output unit 223b receives the second clock signal CLK2 and transmits the voltage of the second clock signal CLK2 to the second output OUT_2(n). By raising the voltage level of the control node An via the second output capacitor 230b, the second output unit 223b charges the second output OUT_2(n) rapidly. In addition, the voltage level of the first output OUT_1(n) is discharged to the low voltage level, namely, Vss, via the first output OUT_1(n).

At the clock cycle time T4, the control node An is a floating point. Because the control node An is high leveled, the third output unit 223c receives the third clock signal CLK3 and transmits the voltage of the third clock signal CLK3 to the third output OUT_3(n). By raising the voltage level of the control node An via the third output capacitor 230c, the third output unit 223c charges the third output OUT_3(n) rapidly. In addition, the voltage level of the second output OUT_2(n) is discharged to the low voltage level via the second output OUT_2(n). At the clock cycle time T5, the control node An is a floating point. Because the control node An is high leveled, the fourth output unit 223d receives the fourth clock signal CLK4 and transmits the voltage of the fourth clock signal CLK4 to the fourth output OUT_4(n). By raising the voltage level of the control node An via the fourth output capacitor 230d, the fourth output unit 223d charges the fourth output OUT_4(n) rapidly. In addition, the voltage level of the third output OUT_3(n) is discharged to the low voltage level via the third output OUT_3(n). At the clock cycle time T6, the control node An is a floating point. The fourth output OUT_4 is discharged to the low voltage level. At the clock cycle time T7, the control node An is discharged to the low voltage level through the reverse input unit 222. Then at the clock cycle time T8, due to the parasitic capacitance of the output units 223, noises will be occurred at the control node An. Meanwhile, the second transistor 226 of the noise free unit 22a is turned on, stabilizing the control node An at the low voltage level and thus filtering out the noises of the parasitic capacitance.

Please refer to FIGS. 1B and 2B. FIG. 2B shows waveforms of the driving circuit in the reverse scanning mode. Because FIG. 2B is the reverse of FIG. 2A, the reverse input unit 222 is used for charging the control node An. On the other hand, the forward input unit 221 discharges the control node An after a clock cycle time when the output units 223 produce the plurality of reverse scanning signals. Thereby, the second input voltage Vdd_r is high leveled (Vdd) while the first input voltage Vdd_f is low leveled. According to the present embodiment, the first input voltage Vdd_f is pulled down to the reference voltage Vss. Referring to FIG. 2B, the reverse input unit 222 of the driving module 22 is used instead for charging the control node An in the clock cycle times from T1 to T7 while the forward input unit 221 discharges the control node An. The rest operations are the same as those described in the embodiment of FIG. 2A.

It is known from the above description that the driving module 22 according to the present invention charges the control node An by using the forward and reverse input units 221, 222, respectively, for driving the plurality of output units 223*a*, 223*b*, 223*c*, 223*d* to provide the scanning signals of different scanning modes. In addition, in any scanning mode, the driving module 22 according to the present invention requires only the forward and reverse input units 221, 222 to charge and discharge the control node An alternately and hence simplifying the circuit. Furthermore, because the noise free unit 224 receives the clock signal CLK1 via the control capacitor 231, the voltage and current of the clock signal will not flow to the reference voltage Vss directly, which reduces unnecessary DC consumption. Besides, because the driving module 22 operates according to at least three clock signals, continuous turning on/cutoff of the output units 223 and the first noise free unit 224 according to the clock signals is prevented and thereby avoiding unnecessary power consumption of the output units 223 and the first noise free unit 224 in the non-operating period.

Figure 3:
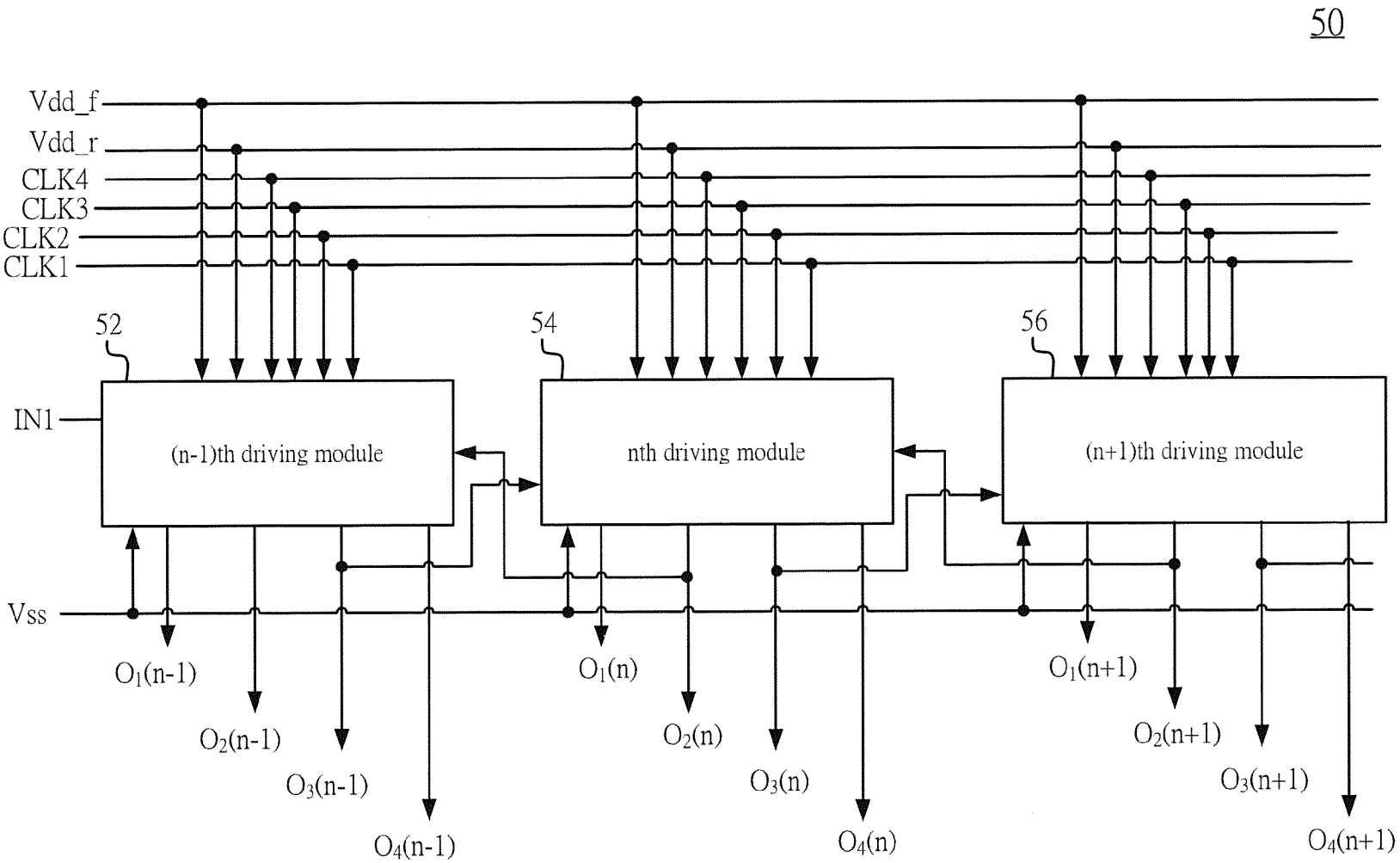
FIG. 3 shows a block diagram of the bidirectional scanning driving circuit according to an embodiment of the present invention.

FIG. 3 shows a block diagram of the bidirectional scanning driving circuit according to an embodiment of the present invention. As shown in the figure, the driving circuit 50 according to the present invention comprises a plurality of driving modules. According to the present embodiment, an (n−1)th driving module 52, an n-th driving module 54, and an (n+1)th driving module 56 are used as an example. The detailed circuits of the (n−1)th driving module 52, the n-th driving module 54, and the (n+1)th driving module 56 are the same as that of the driving module 22 described in the previous embodiment. Because the (n−1)th driving module 52 according to the present embodiment is the starting driving module, which means there is no (n−2)th driving module to be connected with the (n−1)th driving module 52, the (n−1)th driving module 52 receives an input signal IN1. The operations of the (n−1)th driving module 52 to the (n+1)th driving module 56 are the same as those of the first driving module 22*a* to the third driving module 22*c* as shown in FIGS. 1A and 1B. The (n−1)th driving module 52 to the (n+1)th driving module 56 receive the first clock signal CLK1 to the fourth clock signal CLK4, respectively. Besides, the (n−1)th driving module 52, the n-th driving module 54, and the (n+1)th driving module 56 are all coupled to the first input voltage Vdd_f, the second input voltage Vdd_r, and the reference voltage Vss. The reference voltage Vss is equivalent to the low voltage level, for example, 1V, of the scanning circuit. The first output signal $O_1(n-1)$ to the fourth output signal $O_4(n-1)$ of the (n−1)th driving module 52, the first output signal $O_1(n)$ to the fourth output signal $O_4(n)$ of the n-th driving module 54, and the first output signal $O_1(n+1)$ to the fourth output signal $O_4(n+1)$ of the (n+1)th driving module 56 are just the scanning signals of the pixels 402.

When forward scanning starts, the (n−1)th driving module 52 outputs the first output signal $O_1(n-1)$ to the fourth output signal $O_4(n-1)$ to the pixels 402 sequentially. In other words, the (n−1)th driving module 52 outputs its first scanning signal to the fourth scanning signal to the pixels 402. Meanwhile, the (n−1) driving module 52 transmits the third output signal $O_3(n-1)$ to the n-th driving module 54. Namely, the (n−1) driving module 52 output its third scanning signal to the n-th driving module 54. The n-th driving module 54 also outputs the first output signal $O_1(n)$ to the fourth output $O_4(n)$ signal to the pixel 402. In other word, the n-th driving module 54 outputs its first to fourth scanning signals to the pixel 402. In addition, the n-th driving module 54 also transmits the third output signal $O_3(n)$ to the (n+1)th driving module 56 at the same time. Namely, the n-th driving module 54 outputs its third scanning signal to the (n+1)th driving module 56. When the (n+1)th driving module 56 receives the third output signal $O_3(n)$, it outputs the first output signal $O_1(n+1)$ to the fourth output signal $O_4(n+1)$ to the pixel 402. That is to say, the (n+1) driving module 56 outputs its first to fourth scanning signals to the pixel 402. Meanwhile, the (n+1)th driving module 56 transmits the third output signal $O_3(n+1)$ to the driving module of the next stage. Namely, the third output signal $O_3(n+1)$ is transmitted to the (n+2)-th driving module (not shown in the figure); the (n+1)th driving module 56 will output the third scanning signal to the (n+2)th driving module.

Moreover, according to the present embodiment, three driving modules are used as an example. Nonetheless, the present invention is not limited to this example. According to the present embodiment, more than three driving modules can be used for providing the scanning signals for forward or reverse scanning. According to the embodiment described above, the output units according to the present invention share the control node and thus allowing each driving module to output a plurality of scanning signals. Thereby, the circuit area of the driving modules can be reduced. To sum up, the present invention provides a driving module with a common control node. The forward input unit and the reverse input unit charges and discharges the control node in the forward and reverse scanning modes, respectively. Thereby, when the forward input unit is charging the control node, a plurality of output units are driven to produce a plurality of forward scanning signals sequentially; when the reverse input unit is charging the control node, the plurality of output units are driven to produce a plurality of reverse scanning signals sequentially. Consequently, the present invention supports bidirectional scanning. Besides, because a plurality of output units share the control node, the charging and discharging mechanism of the control node and the circuit layout of the driving module are simplified.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. An n-th stage driving module with a common control node, producing a plurality of scanning signals sequentially and outputting to a display panel sequentially, receiving a plurality of clock signals and receiving a first input voltage and a second input voltage, respectively, the n-th stage driving module comprising:

a plurality of output units, all coupled to a control node, and receiving said plurality of clock signals;

a forward input unit, coupled to said control node, receiving said first input voltage and a front forward scanning signal of said output unit of any driving module lower than or equal to the (n−1)th stage, and charging and discharging said control node according to said first input voltage and said front forward scanning signal;

a reverse input unit, coupled to said control node, receiving said second input voltage and a back reverse scanning signal of said output unit of any driving module higher than or equal to the (n+1)th stage, and charging and discharging said control node according to said second input voltage and said back reverse scanning signal; and a noise free unit, coupled to said forward input unit, said reverse input unit, and said plurality of output units, receiving a first clock signal, and filtering out the noises at said control node of said plurality of output units, the n-th stage driving module further comprising:

a control capacitor, having a first terminal for receiving said first clock signal, and producing a control level according to said first clock signal;

a first transistor, having a first terminal coupled to a second terminal of said control capacitor, said first transistor having a second terminal coupled to said forward input unit, said reverse input unit and said control node; and a second transistor, having a first terminal coupled to said forward input unit, said reverse input unit, and said control node, said second transistor having a second terminal coupled to said first terminal of said first transistor and said second terminal of said control capacitor, and said second transistor having a third terminal of said first transistor and a third terminal of said second transistor coupled to a reference level, wherein said forward input unit charges said control node according to said first input voltage and said front forward scanning signal, and said plurality of output units produce and forward output a plurality of forward scanning signals sequentially according to said plurality of clock signals and said control node, respectively, and said reverse input unit charges said control node according to said second input voltage and said back reverse scanning signal, and said plurality of output units produce and reversely output a plurality of reverse scanning signals sequentially according to said plurality of clock signals and said control node, respectively, and n is an integer greater than one.

2. The n-th stage driving module of claim 1, wherein said plurality of clock signals include said first clock signal, a second clock signal, a third clock signal, and a fourth clock signal output to the n-th stage driving module cyclically.

3. The n-th stage driving module of claim 1, further comprising a plurality of output capacitors, having a first terminal coupled to said control node, respectively, and having a second terminal coupled to said third terminals of said plurality of output units, respectively.

4. The n-th stage driving module of claim 1, wherein when said forward input unit charges said control node according to said first input voltage and said front forward scanning signal, said reverse input unit discharges said control node after said plurality of output units produce one of said plurality of forward scanning signals.

5. The n-th stage driving module of claim 1, wherein when said reverse input unit charges said plurality of output units according to said second input voltage and said back reverse scanning signal, said forward input unit discharges said control node after said plurality of output units produce one of said plurality of reverse scanning signals.

6. The n-th stage driving module of claim 1, wherein said plurality of output units are a plurality of transistors each having a first terminal coupled to said control node, a second terminal receiving said plurality of clock signals, and a third terminal outputting said plurality of scanning signals.

* * * * *